US008381424B2

(12) United States Patent
Christopherson

(10) Patent No.: US 8,381,424 B2
(45) Date of Patent: Feb. 26, 2013

(54) ASSEMBLY FOR DOOR ADVERTISEMENTS

(76) Inventor: Roth K. Christopherson, Wichita, KS (US)

( * ) Notice: Subject to any disclaimer, the term of this patent is extended or adjusted under 35 U.S.C. 154(b) by 0 days.

(21) Appl. No.: 12/904,629

(22) Filed: Oct. 14, 2010

(65) Prior Publication Data

US 2012/0090209 A1 Apr. 19, 2012

(51) Int. Cl.
*G09F 3/00* (2006.01)

(52) U.S. Cl. ..... 40/674; 40/663

(58) Field of Classification Search ..... 40/663, 40/664, 668, 674; 24/72.7, 453
See application file for complete search history.

(56) References Cited

U.S. PATENT DOCUMENTS

| | | | | |
|---|---|---|---|---|
| 1,524,893 | A * | 2/1925 | Thompson | 40/663 |
| 2,063,155 | A * | 12/1936 | Flood | 40/663 |
| 2,985,006 | A * | 5/1961 | Du Bois | 70/458 |
| 3,850,297 | A * | 11/1974 | Merser | 206/343 |
| 2007/0266605 | A1 * | 11/2007 | Halbur et al. | 40/674 |

* cited by examiner

*Primary Examiner* — Joanne Silbermann
(74) *Attorney, Agent, or Firm* — Mitchell Law PLLC; Matthew W. Mitchell

(57) ABSTRACT

An assembly for advertising on a door is disclosed. The assembly includes material having an aperture therein and having a first planar surface configured to receive an advertisement message, and a fastener comprising a loop-shaped first end contiguously connected to a T-shaped second end fastened through the aperture. The loop-shaped first end of the fastener is configured to flex around a door protrusion such as a knob, lever, or hinge.

17 Claims, 14 Drawing Sheets

ASSEMBLY FOR DOOR ADVERTISEMENTS

BACKGROUND

The method includes a fastener to aid and enhance the distribution and functionality of advertisements. The current form of distributing advertisements door to door is inefficient and ineffective due to design flaws and cost.

Traditional die cut door hangers were originally designed to hang on round doorknobs and are not a very secure way to distribute to every door. Round door knobs have mostly been replaced with a modern variety of door knobs and levers in various shapes and sizes. The door hanger distributor wastes time struggling to attach the traditional die cut door hangers to knobs and handles that simply won't accept the design. Traditional die cut door hangers may become torn and messy making it look more like trash resulting in the customers disgust and final decision to just discard the piece altogether. The traditional die cut door hanger easily falls or blows off the doorknob and becomes litter in the customers' lawn which irritates the customer and frustrates the advertisers. Traditional die cut door hangers use up a lot of crucial and valuable design space on both the front and back of the advertisement to allow for the hole and slit used to attach the hanger to the door knob. Between lost advertising space and not being able to securely hang the advertisement on every door, this method of door hanger distribution is neither efficient nor cost effective.

Another common form of distributing advertisements door to door is the use of rubber bands. Using rubber bands to distribute door hangers is cumbersome and time consuming. The design of the rubber band does not make it easy to insert the band through the hole used in the advertisement that accommodates the rubber band. The material used to make rubber bands has memory so when trying to change its circular shape, by pressing two sides of the band together to form a thin enough portion to insert through the hole, it becomes awkward and time consuming because the rubber band is fighting the attempt to change its shape. Rubber bands typically used to distribute door hangers break easily if pulled too hard to stretch around larger handles or objects; and, may tear the advertisement. If the rubber band is small enough to provide a snug fit around the door knob, it is typically too small to handle without tearing the advertisement while looping the band through the hole placed in the material to accommodate the band. Once the rubber band is attached to the advertisement there are still more issues encountered during distribution. Due to the rubber band being one continuous piece, while attempting to attach the advertisement to the door by stretching the rubber band to fit around the knob, stress is placed on the advertisement causing it to tear and not securely stay on the door. On the other hand, if the rubber bands are too large they do not provide a snug enough fit to allow the piece to securely stay on the knob. The labor and material waste are not cost effective for advertisers or door hanger distributors. Ultimately rubber bands are not an efficient way of distributing advertisements door to door due to the design flaws and nature of the method.

Whether the distributor is using a traditional die cut or rubber band as their method to distribute the door hangers, neither option is conducive for generating high return results, because the advertisement cannot be displayed in the consumers view on their refrigerator, file cabinet, or other surface. One method advertisers use to increase return results, is to attach magnets to advertisements. This method is typically expensive and ineffective as magnets only adhere to magnetic surfaces. Today, so many homes have refrigerators with nonmagnetic surfaces, such as stainless steel and plastic or coated material, the magnets simply aren't effective.

SUMMARY

The methods for distributing advertisements door to door were never perfected and have now been negatively impacted by the modernization of door knobs. This method includes a more secure option that may be utilized during the distribution of an advertisement. This method allows the advertisement to be securely attached to virtually any doorknob, lever, door, or object, and subsequently brought inside the home by the consumer and displayed on the refrigerator, cabinet or other object making it possible for the advertisers' message to stay in view and top of mind.

This method incorporates an advertisement with a hole to accommodate a fastener. The fastener is used to securely attach the advertisement during door to door distribution. The fastener has a unique design that has two portions, a circular portion and a T shape extension. The T shape extension makes inserting the fastener into the hole a simple process. No pinching, folding, looping or knot tying required. The circular portion of the fastener is used for attaching the advertisement to the door knob. Because of the unique design, when the circular portion is stretched for putting around door knobs it does not put any stress or tension on the advertisement. This keeps the advertisement from tearing, eliminating the trashy look which often results from using traditional die cut and rubber band methods that often become torn during distribution. The method does not require any extra looping, tying or cutting making it extremely simple, easy to use and may be distributed faster because it eliminates so many of the issues encountered while attempting to attach the advertisement using other methods.

This method may be applied to various types of suitable advertisements such as booklets, flyers, door hangers, or business cards. The unique design of the fastener also allows more than one advertisement to be attached to a door using only one fastener. Applying this method to an advertisement that utilizes adhesive would enhance this method even further by increasing the advertisers return on investment. The consumer may use the adhesive, after the advertisement is brought inside, to keep the advertisement in view while displayed on the refrigerator, cabinet or other object.

This method is easy to use, secure and more efficient then other door to door distribution methods available saving the distributor and advertiser time and money because it is economical and cost effective. Also by eliminating the space necessary to accommodate the hole and slit the traditional die cut door hanger requires, the advertiser is free to use virtually the entire piece for their ad, creating even more benefits for the advertiser.

| DrawingsReference Numerals | |
|---|---|
| 2 | Hanger |
| 3 | Die Cut Hanger |
| 4 | First Planer Surface |
| 5 | Second Planer Surface |
| 6 | Second Hanger |
| 7 | Fastener |
| 8 | Hole |
| 9 | Slit |
| 10 | Coupon |
| 11 | Advertisement |
| 12 | Rubber Band |
| 13 | Perforations |

-continued

| DrawingsReference Numerals | |
|---|---|
| 14 | Door |
| 15 | Refrigerator |
| 16 | Door Knob |
| 17 | Door Lever |
| 18 | Push Button Handle |
| 19 | Other Shape |
| 20 | Booklet |
| 21 | Liner |
| 22 | Adhesive |
| 23 | Folded Hanger |
| 24 | T Shape Extension |
| 25 | Circular Portion |
| 26 | Blank Advertisement |
| 27 | Delineations |
| 28 | Rip |

DETAILED DESCRIPTION

Figure 1:
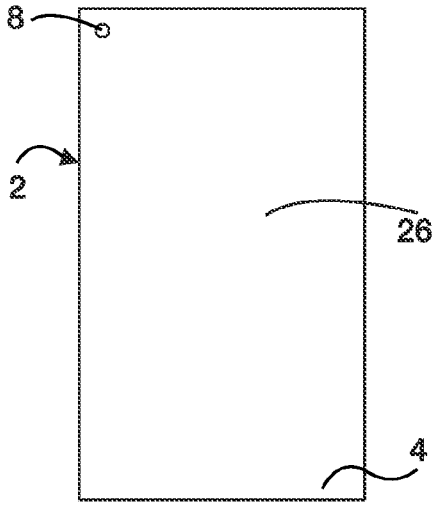
FIG. 1 is a front view of a 1$^{st}$ planer surface of the advertisement, incorporating a hole to accommodate a fastener.
Figure 2:
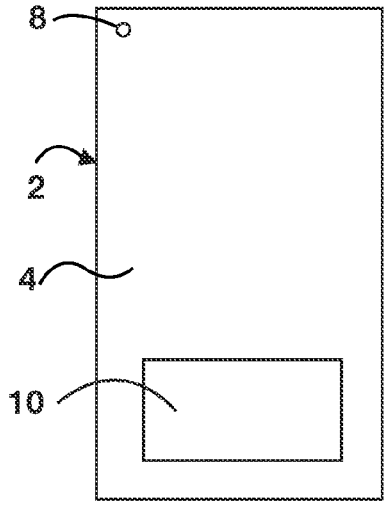
FIG. 2 is a front view of a 1$^{st}$ planer surface of the advertisement, incorporating a coupon.
Figure 3:
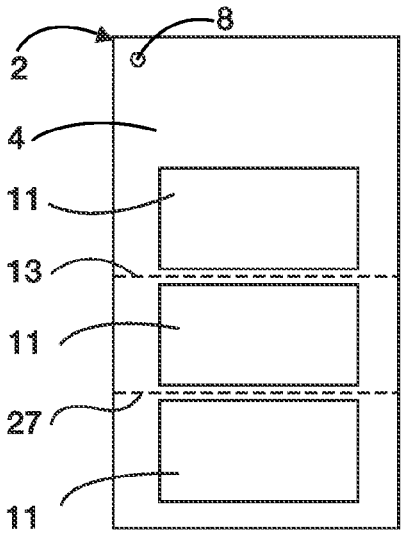
FIG. 3 is a front view of a 1$^{st}$ planer surface of the advertisement, incorporating multiple advertisements and perforations.
Figure 4:
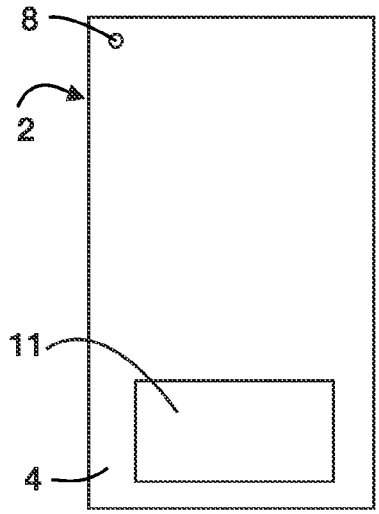
FIG. 4 is a front view of a 1$^{st}$ planer surface of the advertisement, incorporating an advertisement.
Figure 7:
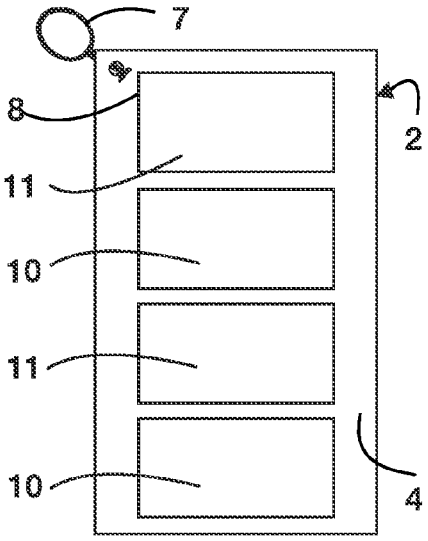
FIG. 7 is a front view of a 1$^{st}$ planer surface of the advertisement, incorporating the fastener and a plurality of coupons and advertisements.
Figure 8:
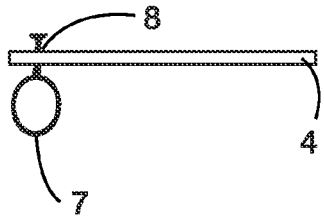
FIG. 8 is a side edge view of the article of FIG. 7.
Figure 9:
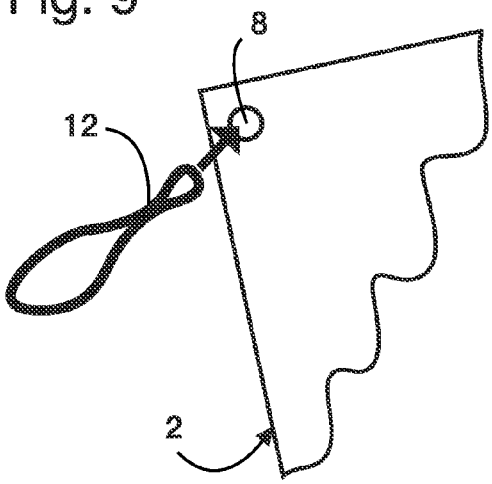
FIG. 9 is a front view of an advertisement showing a rubber band being lined up to be inserted into a hole in a hanger.
Figure 10:
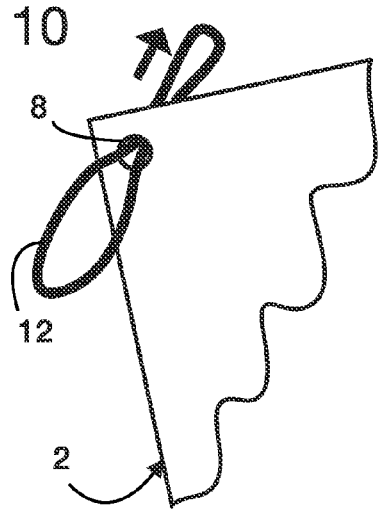
FIG. 10 is a front view of an advertisement showing a rubber band being inserted into a hole in a hanger.
Figure 11:
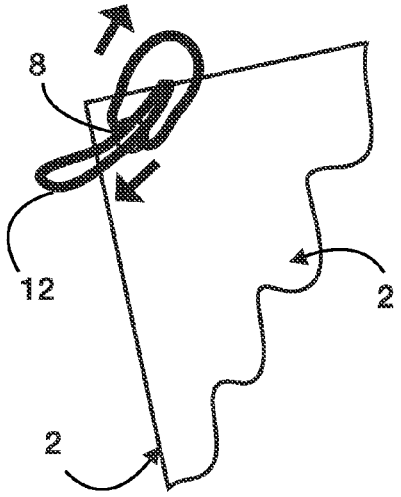
FIG. 11 is a front view of an advertisement showing a rubber band used to create a slip knot loop through a hole in a hanger.
Figure 12:
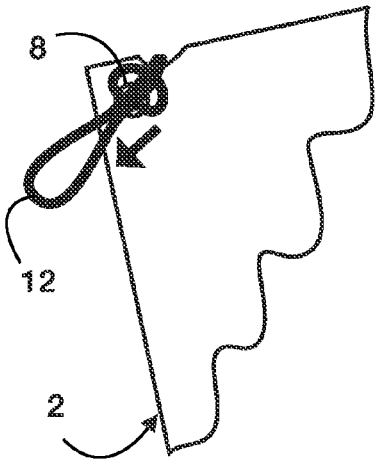
FIG. 12 is a front view of an advertisement showing a rubber band completely looped through a hole in a hanger, causing damage to the advertisement.
Figure 25:
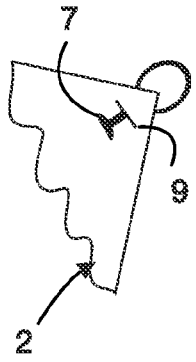
FIG. 25 is an embodiment of the method using a slit instead of a hole to accommodate the fastener.
Figure 26:
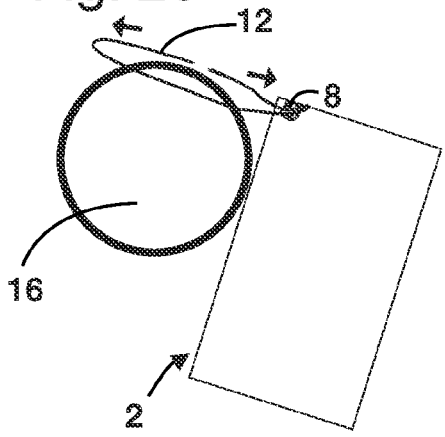
FIG. 26 is a view showing a rubber band being stretched over a door knob and said rubber band breaking.
Figure 27:
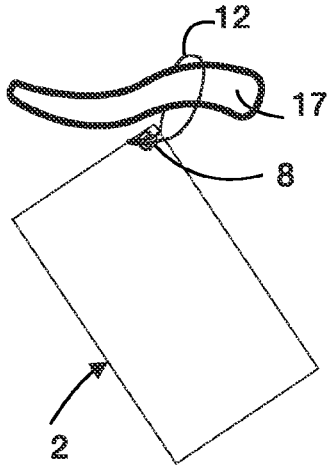
FIG. 27 is view of the rubber band in FIG. 12 attaching an advertisement to a lever.

The method includes a fastener 7 that provides enhancement for the distribution of an advertisement door to door. FIGS. 1, 2, 3, and 4 illustrate a hanger 2, used by advertisers to communicate information, services, and special offers to the public, from here on referred to as an advertisement. The advertisement is used to distribute this information door to door so it will reach the consumer at a business or residence. The advertisement can be a sheet of flexible or rigid material, including a first planar surface 4, and a hole 8 to accommodate a fastener 7 shown best in FIG. 13. FIG. 25, is another embodiment of the method, using a slit 9 instead of a hole 8 to accommodate the fastener 7. In one embodiment the first planar surface 4 could have an advertisement 11, shown in FIG. 4, or coupon 10, shown in FIG. 2, or a plurality of advertisements 11, shown in FIG. 3, or a plurality of advertisements 11 with a plurality of coupons 10 shown in FIG. 7. The coupons 10 could have one or multiple delineations 27 or perforations 13 to facilitate removal of said coupons 10 from the advertisement as shown in FIG. 3. In another embodiment, this advertisement could initially be blank 26, as shown in FIG. 1, with the intention of the advertiser printing their own information on the advertisement.

Figure 5:
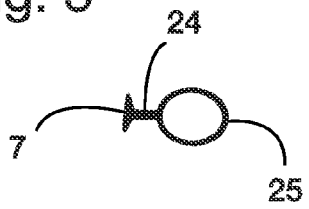
FIG. 5 is a front view of the fastener included in the method.
Figure 6:
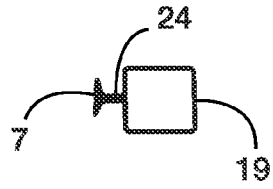
FIG. 6 is a front view of a further embodiment of a fastener.
Figure 5A:
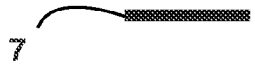
FIG. 5*a* is a side edge view of the article of FIG. 5.
Figure 6A:
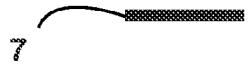
FIG. 6*a* is a side edge view of the article of FIG. 6.
Figure 13:
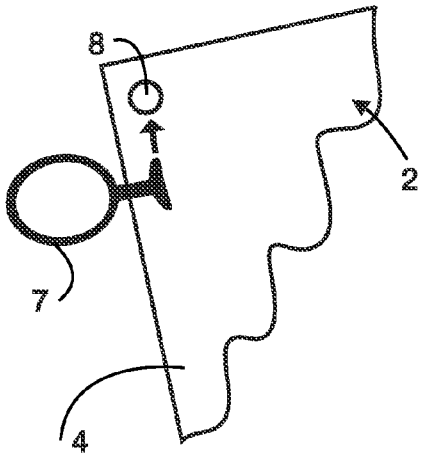
FIG. 13 is a front view of a 1$^{st}$ planer surface of the advertisement, in accordance with an embodiment of the method, showing the T shape extension portion of the fastener getting ready to be inserted into the hole.
Figure 14:
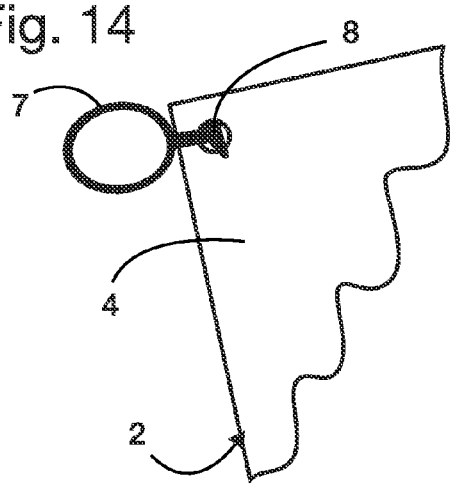
FIG. 14 is a front view of a 1$^{st}$ planer surface of the advertisement, in accordance with an embodiment of the method, showing the T shape extension portion of the fastener being inserted into the hole.
Figure 15:
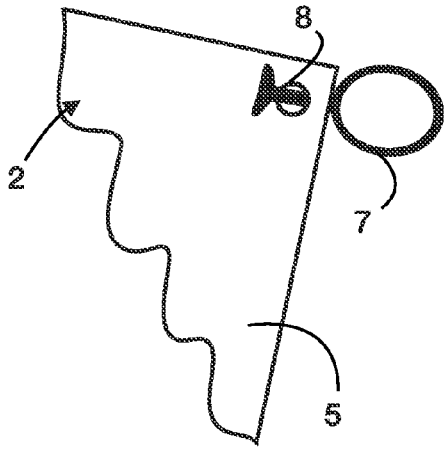
FIG. 15 is a front view of a 2$^{nd}$ planer surface of the advertisement in accordance with an embodiment of the method, showing the T shape extension portion of the fastener completely inserted through the hole.
Figure 16:
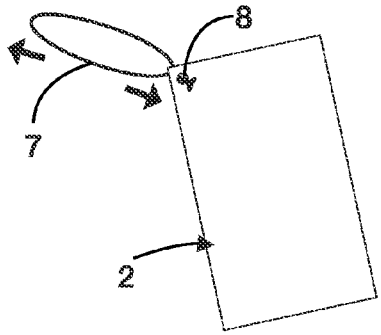
FIG. 16 is a front view of FIG. 1 showing the circular portion of the fastener being stretched and ready to apply to a door knob.
Figure 17:
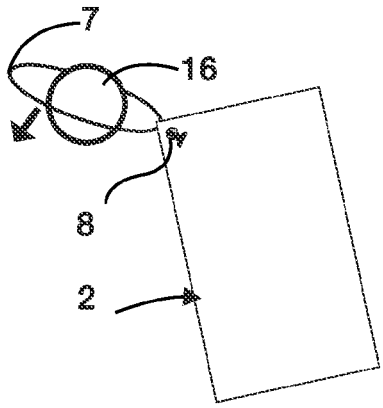
FIG. 17 is a front view of FIG. 1 with the circular portion of the fastener being attached to a door knob.
Figure 18:
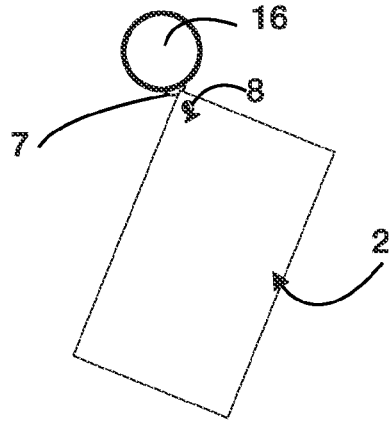
FIG. 18 is a front view of FIG. 1 after using the fastener to attach to a door knob.
Figure 19:
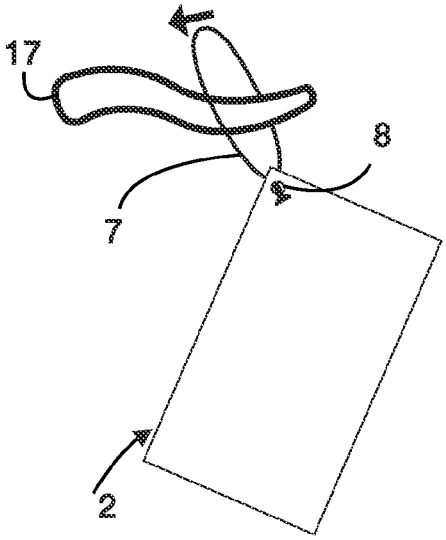
FIG. 19 is a front view of FIG. 16 showing the circular portion of the fastener being stretched and attached to a door lever.
Figure 20:
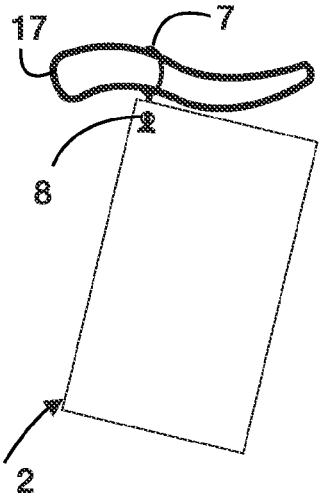
FIG. 20 is a front view of FIG. 16 after using the fastener to attach to door lever.
Figure 21:
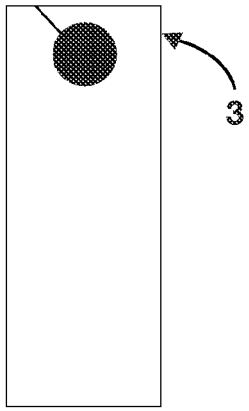
FIG. 21 is a view of a die cut hanger advertisement.
Figure 22:
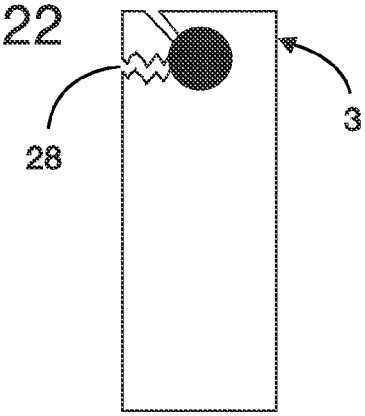
FIG. 22 shows a die cut hanger that has a rip or has been torn.
Figure 23:
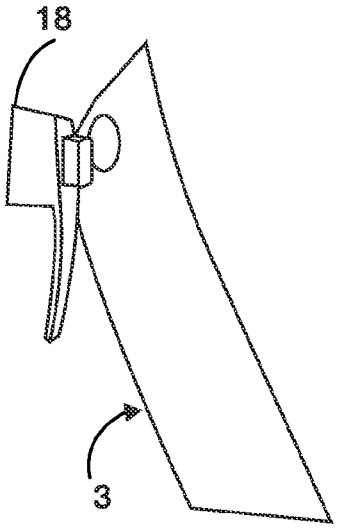
FIG. 23 is a view of die cut hanger that cannot be attached on a push button handle.
Figure 24:
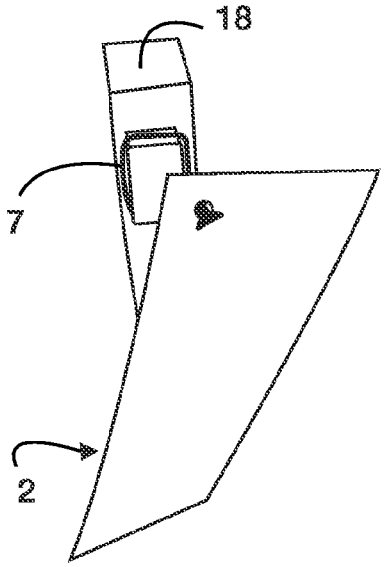
FIG. 24 is a view of an advertisement attached to the same push button handle in FIG. 23 using the circular portion of the fastener.
Figure 32:
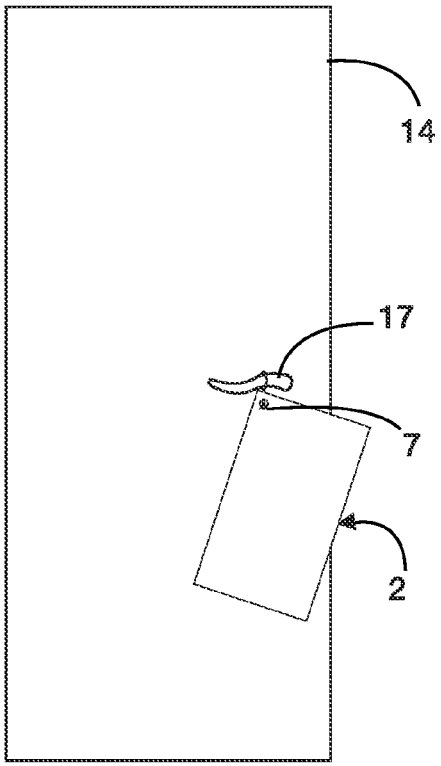
FIG. 32 is an embodiment of the method showing a front view of an advertisement attached to a door lever on a door using the circular portion of the fastener.
Figure 33:
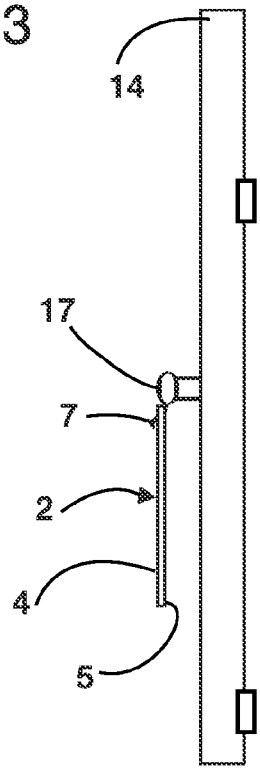
FIG. 33 is a side edge of FIG. 32.

The fastener 7, shown in FIG. 5, incorporated in the method, is used to securely attach the advertisement to a door knob 16 or lever 17, shown in FIGS. 17, 18, 19, 20, during door to door distribution. The fastener 7 design has two portions, a circular portion 25 and a T shaped extension 24. In another embodiment the fastener 7 is not limited to this T shape 24 or circular shape 25, as shown in FIG. 6. The T shaped extension 24 is inserted into the hole 8 in the advertisement, as shown in FIG. 13 and FIG. 14, attaching the fastener 7 and advertisement snugly to each other, shown in FIG. 15. The circular portion 25 of the fastener 7 may be stretched to fit around a door knob 16, as shown in FIG. 17, securely attaching the advertisement to the door knob, as shown in FIG. 18. The circular portion of the fastener may be stretched without easily breaking and without placing any stress on the T shaped extension portion of the fastener or the advertisement, shown in FIG. 16. Another embodiment included in this method incorporates the fastener 7 attaching the advertisement to a variety of door knobs including a lever 17, shown in FIG. 32, and a push button handle 18, shown in FIG. 24.

Figure 28:
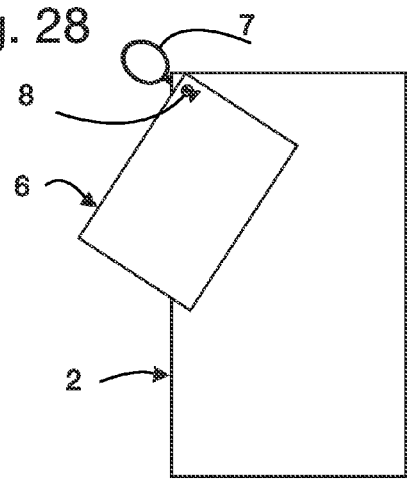
FIG. 28 is a further embodiment of the method showing a hanger and a second hanger being attached with one fastener.
Figure 29:
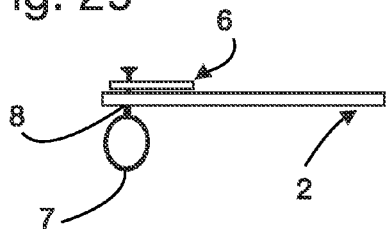
FIG. 29 is a side edge view of FIG. 28.
Figure 30:
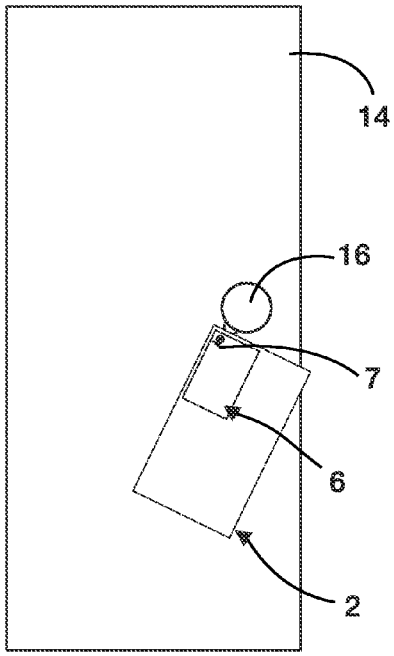
FIG. 30 is a front view of FIG. 28 being attached to a door knob on a door using the circular portion of the fastener.
Figure 31:
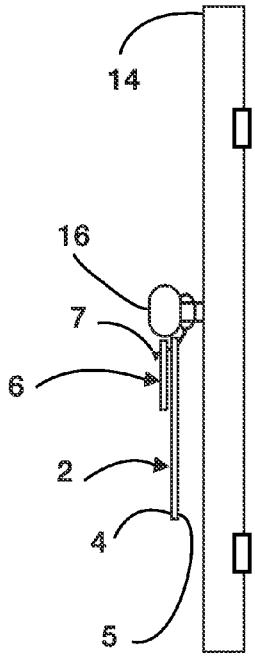
FIG. 31 is a side edge view of FIG. 30.
Figure 34:
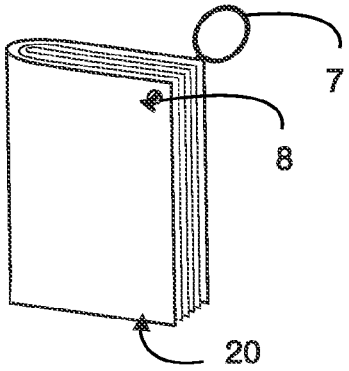
FIG. 34 is an embodiment of the method showing the fastener attached to a booklet.
Figure 36:
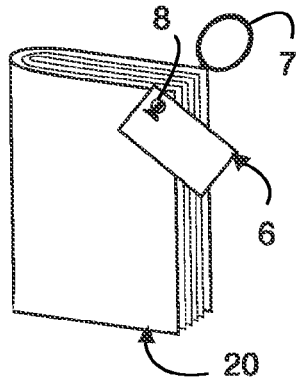
FIG. 36 is another embodiment of the method showing a second hanger attached to a booklet using a fastener.
Figure 35:
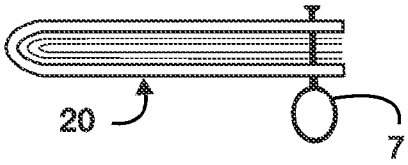
FIG. 35 is a side edge view of FIG. 34.
Figure 37:
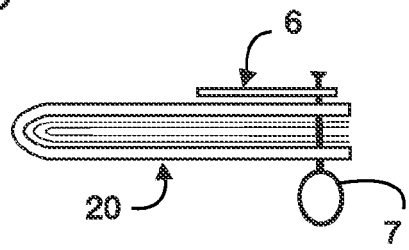
FIG. 37 is a side edge view of FIG. 36.
Figure 38:
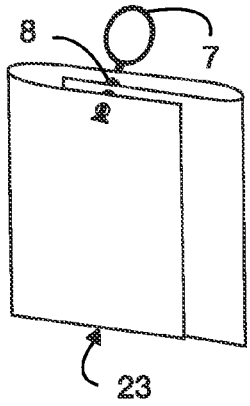
FIG. 38 is an embodiment of the method showing the fastener attached to a folded hanger
Figure 40:
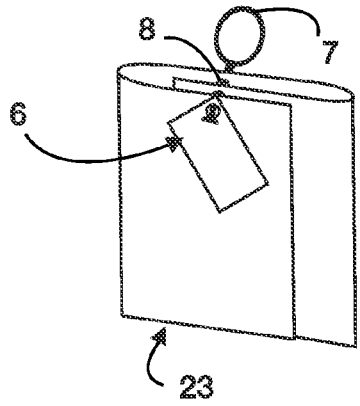
FIG. 40 is another embodiment of the method showing a second hanger attached to a folded hanger using a fastener.
Figure 39:
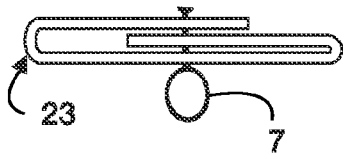
FIG. 39 is a side edge view of FIG. 38.
Figure 41:
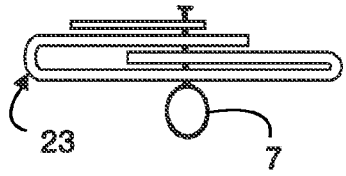
FIG. 41 is a side edge view of FIG. 40
Figure 42:
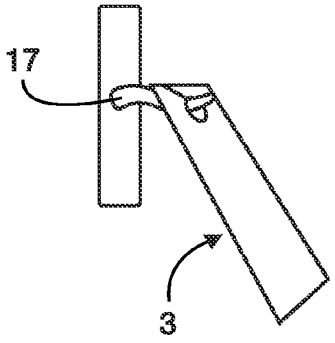
FIG. 42 is a view of an advertisement, attached to a lever using a die cut hanger, that is starting to blow off.
Figure 42A:
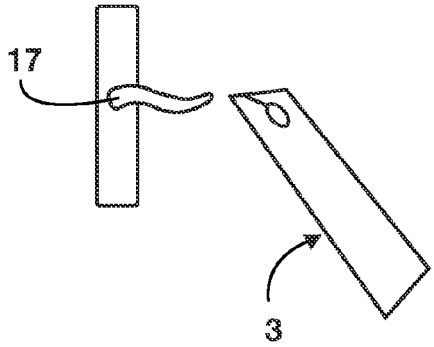
FIG. 42*a* is a view of the advertisement in FIG. 42 no longer attached to the lever after it has blown off

In a further embodiment, the fastener 7 and a folded hanger 23 may be attached securely together, shown in FIG. 38, and the fastener 7 and a booklet 20 may be attached securely together, as shown in FIG. 34. An advertisement and a second hanger 6 may also be attached securely together using one fastener 7, as shown in FIG. 28 and FIG. 30. For example, a folded hanger 23, and a $2^{nd}$ hanger 6, attached together using one fastener 7, shown in FIG. 40.

Figure 43:
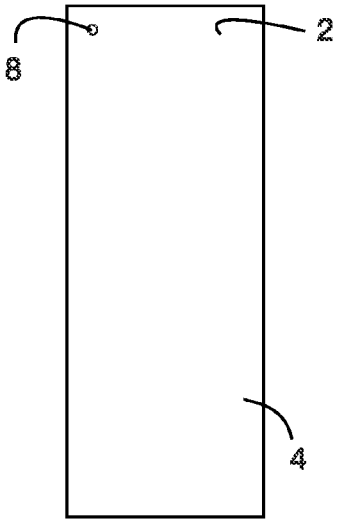
FIG. 43 is a an embodiment of the method showing nearly all of the space on an advertisement available for use by the advertiser.
Figure 43A:
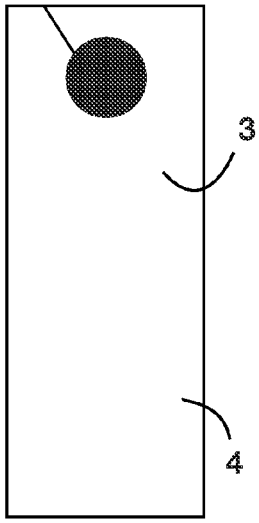
FIG. 43*a* is a view showing the space used up on the advertisement by the die cut hanger.

FIG. 43*a* shows the amount of space wasted with the hole and slit used in the traditional die cut hanger compared to the small hole required for the current method shown in FIG. 43, leaving the advertiser more space to promote their business or advertisement with this method.

Figure 44:
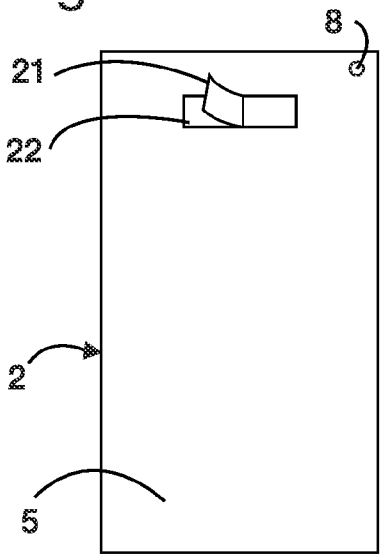
FIG. 44 is an embodiment of the method, showing the back view and second planar surface of an advertisement with a strip of adhesive and a liner covering the adhesive, being pulled partway back to expose said adhesive.
Figure 46:
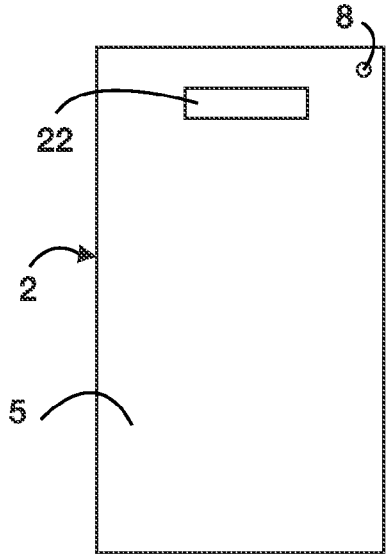
FIG. 46 is a view of FIG. 44 with the liner completely removed to expose the adhesive.
Figure 45:
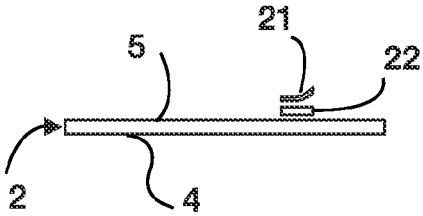
FIG. 45 is a side edge view of FIG. 44.
Figure 47:
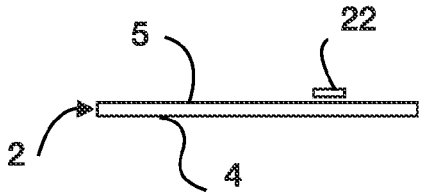
FIG. 47 is a side edge view of FIG. 46.
Figure 48:
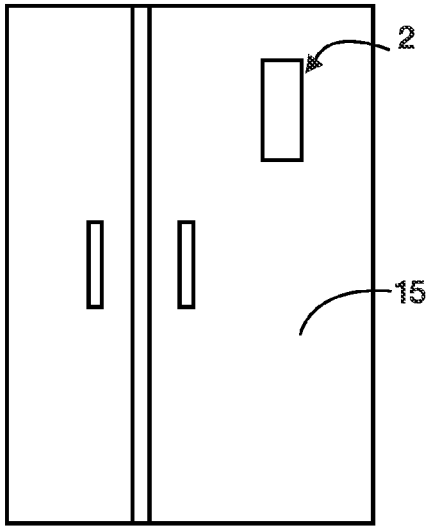
FIG. 48 is an embodiment of the method showing a front view of an advertisement attached to the front of a refrigerator using the adhesive.
Figure 50:
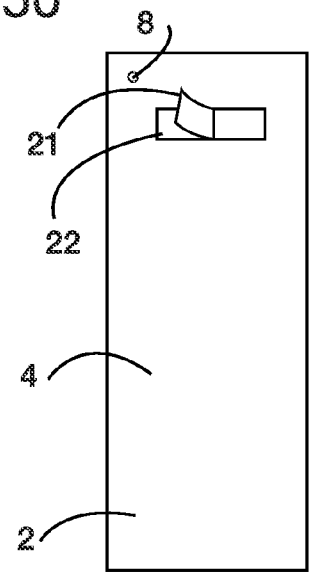
FIG. 50 is an embodiment of the method, showing the front view and first planar surface of an advertisement with a strip of adhesive and a liner covering the adhesive, being pulled partway back to expose said adhesive.
Figure 49:
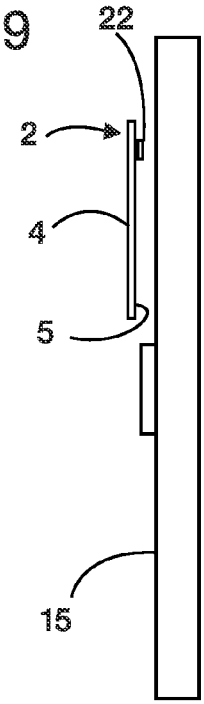
FIG. 49 is a side edge view of FIG. 48.
Figure 51:
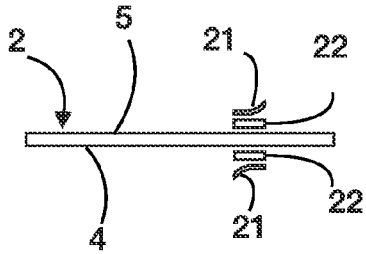
FIG. 51 is a side edge view of FIG. 50.

Applying this method to an advertisement that utilizes adhesive would enhance this method even further by increasing the advertisers return on investment. FIG. 44 is another embodiment of the method, showing the back view and second planar surface 5 of an advertisement with a strip of adhesive 22 and a liner 21 covering the adhesive 22. Another embodiment includes the adhesive 22 and liner 21 on the first planar surface 4 or second planar surface 5, or first planar surface 4 and second planar surface 5, as shown in front view in FIG. 50 and a side edge view in FIG. 51. The consumer may expose said adhesive 22, after the advertisement is brought inside, by peeling the liner 21 part way back, as shown in FIG. 44, or all of the way back, as shown in FIG. 46. The consumer may now use the exposed adhesive 22 to display the advertisement in view on any object or surface, including but not limited to plastic, hard surfaces, glass, wood, or metal; such as refrigerator 15, cabinet, or computer, inside the residence or business, shown as a front view in FIG. 48 and a side edge view in FIG. 49.

What is claimed is:

1. An assembly for advertising on a door, the assembly comprising:

material having an aperture therein and having a first planar surface configured to receive an advertisement message;

an elastic fastener comprising a loop-shaped first end contiguously connected to a T-shaped second end fastened through the aperture;

an attachment element attached to a second planar surface of the material, wherein the attachment element is configured to cover an area less than an area of the second planar surface, and wherein the attachment element includes an adhesive layer disposed outwardly from the material and covered with a removable liner; and wherein the loop-shaped first end of the fastener is configured to flex around a door protrusion.

2. The assembly of claim 1, wherein the material comprises a booklet having a plurality of pages, each page having an overlapping aperture.

3. The assembly of claim 1, wherein the material comprises a perforated portion.

4. The assembly of claim 1, wherein the material comprises a plurality of perforated coupons.

5. The assembly of claim 1, wherein the loop of the loop-shaped end of the fastener is one of a round loop, a narrow loop, an oblong loop, and a rectangular loop.

6. The assembly of claim 1, wherein the aperture is a slit.

7. The assembly of claim 1, wherein the aperture is elliptical-shaped.

8. The assembly of claim 1, wherein the material is folded, and wherein each folded section comprises an aperture positioned to overlap each aperture.

9. An assembly for advertising on a door, the assembly comprising:

a contiguous elongated material having a front surface and a rear surface, said material having a rectangular configuration with two ends which are opposite each other and with two sides, wherein the material is configured to receive an advertisement message;

an aperture positioned substantially therein a corner of the material;

an elastic fastener comprising a loop-shaped first end contiguously connected to a T-shaped second end fastened through the aperture;

an attachment element attached to a second planar surface of the material, wherein the attachment element is configured to cover an area less than an area of the second planar surface, and wherein the attachment element includes an adhesive layer disposed outwardly from the material and covered with a removable liner; and wherein the loop-shaped first end of the fastener is configured to flex around a door protrusion.

10. The assembly of claim 9, wherein the material comprises a booklet having a plurality of pages, each page having an overlapping aperture.

11. The assembly of claim 9, wherein the material comprises a perforated portion.

12. The assembly of claim 9, wherein the material comprises a plurality of perforated coupons.

13. The assembly of claim 9, wherein the loop of the loop-shaped end of the fastener is one of a round loop, a narrow loop, an oblong loop, and a rectangular loop.

14. The assembly of claim 9, wherein the aperture is a slit.

15. The assembly of claim 9, wherein the aperture is elliptical-shaped.

16. The assembly of claim 9, wherein the material is folded, and wherein each folded section comprises an aperture positioned to overlap each aperture.

17. An assembly for advertising on a door, the assembly comprising:

a contiguous elongated material having a front surface and a rear surface, said material having a rectangular configuration with two ends which are opposite each other and with two sides, wherein the material is configured to receive an advertisement message;

an aperture positioned substantially therein a corner of the material, the aperture elliptical-shaped;

an elastic fastener comprising a loop-shaped first end contiguously connected to a T-shaped second end fastened through the aperture;

wherein the loop-shaped first end of the fastener is configured to flex around a door protrusion; and an attachment element attached to a second planar surface of the material, wherein the attachment element is configured to cover an area less than an area of the second planar surface, and wherein the attachment element includes an adhesive layer disposed outwardly from the material and covered with a removable liner.

* * * * *